US006250832B1

(12) United States Patent
Del Vecchio

(10) Patent No.: US 6,250,832 B1
(45) Date of Patent: Jun. 26, 2001

(54) FOUNTAIN-PEN WITH DOUBLE RESERVOIR AND PLUNGER FOR FILLING THE PEN BY MEANS OF SUCTION

(75) Inventor: Dante Del Vecchio, Florence (IT)

(73) Assignee: Visconti S.R.L. (IT)

( * ) Notice: Subject to any disclaimer, the term of this patent is extended or adjusted under 35 U.S.C. 154(b) by 0 days.

(21) Appl. No.: 09/358,139

(22) Filed: Jul. 20, 1999

(30) Foreign Application Priority Data

Jul. 31, 1998 (IT) ..... FI98A0184

(51) Int. Cl.[7] ..... B43K 5/10
(52) U.S. Cl. ..... 401/151; 401/230
(58) Field of Search ..... 401/151, 177, 401/230, 232, 192

(56) References Cited

U.S. PATENT DOCUMENTS 605,035 * 5/1898 Weeks ..... 401/151
940,909 * 11/1909 Vogelmann ..... 401/177
2,070,461 * 2/1937 Watanabe ..... 401/177
2,142,532 * 1/1939 Stenersen ..... 401/192
2,336,028 * 12/1943 Nichol ..... 401/192
2,509,465 * 5/1950 Wing ..... 401/151
2,737,329 * 3/1956 Bolsey ..... 401/232
3,083,690 * 4/1963 Marban ..... 401/151

* cited by examiner

*Primary Examiner*—Charles R. Eloshway
(74) *Attorney, Agent, or Firm*—McGlew and Tuttle, P.C.

(57) ABSTRACT

The fountain-pen comprises a large capacity reserve reservoir (3) for the ink, with a piston type valve (14) that can be operated to fill the pen by suction, and a smaller supply reservoir (10) which is adjacent to the nib (5) and supplies ink to it; the piston type valve (14) is provided in order to hermetically close and open the passage between said reserve reservoir (3) and the supply reservoir (10) so as to transfer ink from said reserve reservoir (3) to said supply reservoir (10) and shut off said supply reservoir (10) from the reserve reservoir (3).

9 Claims, 3 Drawing Sheets

FOUNTAIN-PEN WITH DOUBLE RESERVOIR AND PLUNGER FOR FILLING THE PEN BY MEANS OF SUCTION

FIELD AND BACKGROUND OF THE INVENTION

The problem with fountain-pens has always been that they are prone to ink leaks as a result of changes in pressure and/or temperature. These changes occur when there is a drop in pressure in mountainous areas or on airplanes, or when passing from low temperatures to high temperatures. These changes cause the air contained in the reservoir to expand which results in a corresponding quantity of ink leaking out through the nib, if the latter is pointing downward; the greater the change in pressure, the more ink leaks out. Also, the more air is contained in the reservoir, the more ink will leak out through the nib.

In the fountain-pen's one-hundred-year-plus history, this problem has only partially been solved by attaching fins to the ink-conveying member. The purpose of these fins, which can be seen underneath the nib of any fountain-pen, is to trap small leaks and prevent them from flooding into the cap. The limitations of such a system are that the fins have a limited capacity and work effectively only with very small reservoirs, such as for example a cartridge (capacity of approx. 0.8 cc). With a reservoir of approximately 3 cc the usefulness of the fins is very limited. This problem means that the writing span of fountain-pens currently available is very short, given an average reservoir capacity of approximately 1 cc.

SUMMARY AND OBJECTS OF THE INVENTION

The object of the invention is to enable the pen to be filled with any quantity of ink, the volume of ink depending only on the dimensions of the pen and the plunger, while still preventing ink leaks.

These and other objects and advantages will become apparent from the following text.

According to the invention, the fountain-pen—which has a reservoir for the ink together with means for filling it - comprises a smaller supply reservoir which is adjacent to and supplies the nib, and a manually operated valve which hermetically closes and opens the passage between the abovementioned reserve reservoir and the supply reservoir; by operating the valve ink can be transferred from said reserve reservoir to said supply reservoir.

A fountain-pen can be of the type comprising a piston type valve which slides along the wall of said reservoir and is attached to a rod which extends outside the pen, passing through a sealing bush, and is fixed to an end piece for manually operating said piston type valve so as to fill the pen by means of suction. In this case the piston type valve also constitutes said valve for closing and opening the passage between the two reservoirs; said valve engages in a seat formed by a component which delimits said supply reservoir.

Said component which delimits said supply reservoir is advantageously transparent and allows the amount of ink in said supply reservoir to be visible.

Said piston type valve may be able to move to a limited degree on the rod, between two limits, so that engagement of shaped parts opens or closes a passage between the valve and the rod.

The end piece that operates the valve can be screwed onto the body of the reserve reservoir until it reaches a position in which it shuts off the passage between the valve and the rod and in which said piston type valve bears in a leaktight manner against its seat.

A better understanding of the invention will be gained by reading the description and examining the appended drawing which shows a non-limiting practical example of said invention. In the drawing:

DESCRIPTION OF THE PREFERRED EMBODIMENTS

Figure 1:
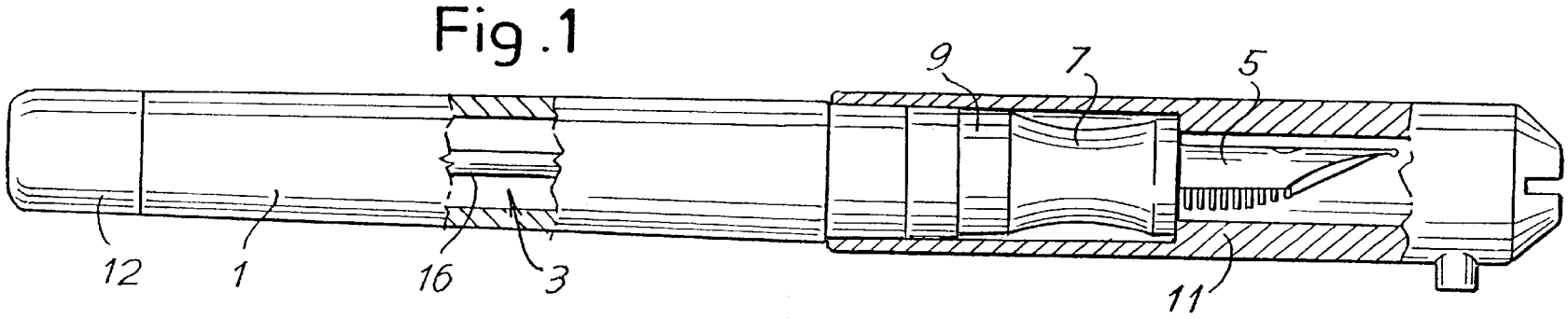
FIG. 1 shows an external view of a pen according to the invention with some parts in section.

As illustrated in the accompanying drawing, the reference 1 denotes the main body of the pen which contains a reservoir 3 of greater capacity which forms the reserve reservoir; 5 denotes the nib, 7 denotes the part adjacent to the nib and forming the grip; 9 denotes a component which is located between the grip 7 and the main body 1 and which delimits a supply reservoir 10 having the functions indicated below. The reference 11 denotes the closure cap and 12 denotes an end piece which is designed to be screwed onto and unscrewed from the body 1 so as to operate an internal member which fills the pen and transfers the ink from the reserve reservoir 3 to the supply reservoir 10 which has a much smaller volume than the reserve reservoir 3. The nib 5 is inserted into a part 5A which is housed inside the grip 7, being screwed into an extension 9A of the component 9 delimiting the supply reservoir 10. The component 9 is screwed in a leaktight manner onto the body 1, and the supply reservoir 10 is then in communication with the reserve reservoir 3, the latter having a widened portion 3A for the purposes that will be discussed below in connection with the system for filling the pen by means of suction. The component 9 forms an annular abutment seat for the purposes indicated below.

Sliding inside the reserve reservoir 3—which, apart from the widened portion 3A, is cylindrical—is a piston type valve 14 which may be made from a relatively elastic material and is attached to a piston rod 16 which is fixed to the end piece 12 by means of a replaceable part 12A secured inside a cavity in the end piece; the piston rod 16 passes through a sleeve 18 fitted with sealing rings 18A, within which the rod 16 can slide with the use of a suitable silicone lubricant or the like. Inside the reservoir 3 the piston rod 16 (see also FIG. 6) has a sealing disk 16A, followed by a cone 16B and a shaped split shank 16C; the piston type valve 14 engages around the areas 16B, 16C of the end of the rod 16 and slides along the cylindrical internal surface of the reserve reservoir 3, an internal axial passage made in the valve 14 forming a sliding and sealing seat for the shaped parts 16A, 16B and 16C of the internal end of the rod 16. As a result of this configuration, the piston type valve 14 can move between the flange 16A and the protruding shaped part of the shaped shank 16C, respectively assuming the position shown in FIG. 6, in which a rod passage 20 is formed between the end of the rod and the piston type valve 14, and the position shown in FIGS. 4 and 5, in which this passage is hermetically closed as a result of the piston type valve 14 bearing against the flange 16A and against the conical part 16B of the internal end of the rod 16.

The component 9 has, in particular, the end 9B which forms an annular abutment seat for the front peripheral edge 14A of the piston type valve 14, which is on the right-hand side in FIGS. 2 to 6.

Figure 4:
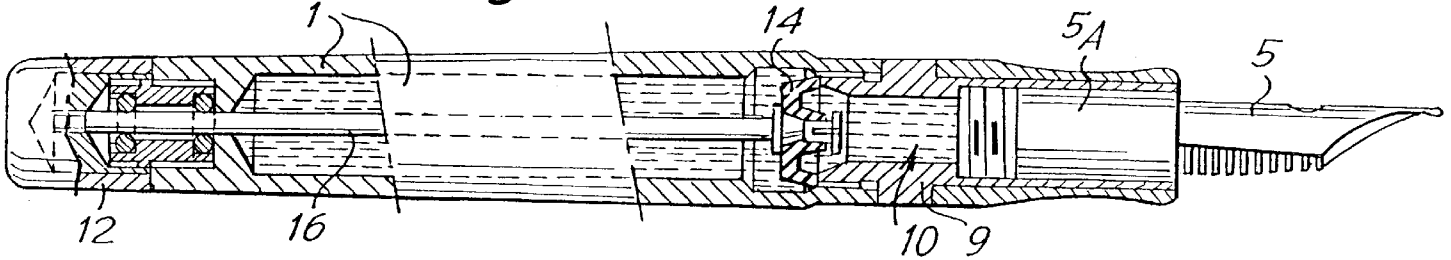
Figure 5:
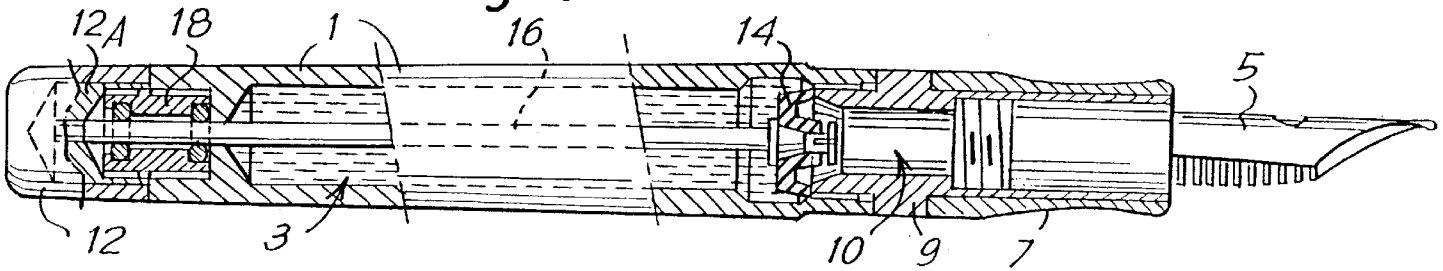
Figure 6:
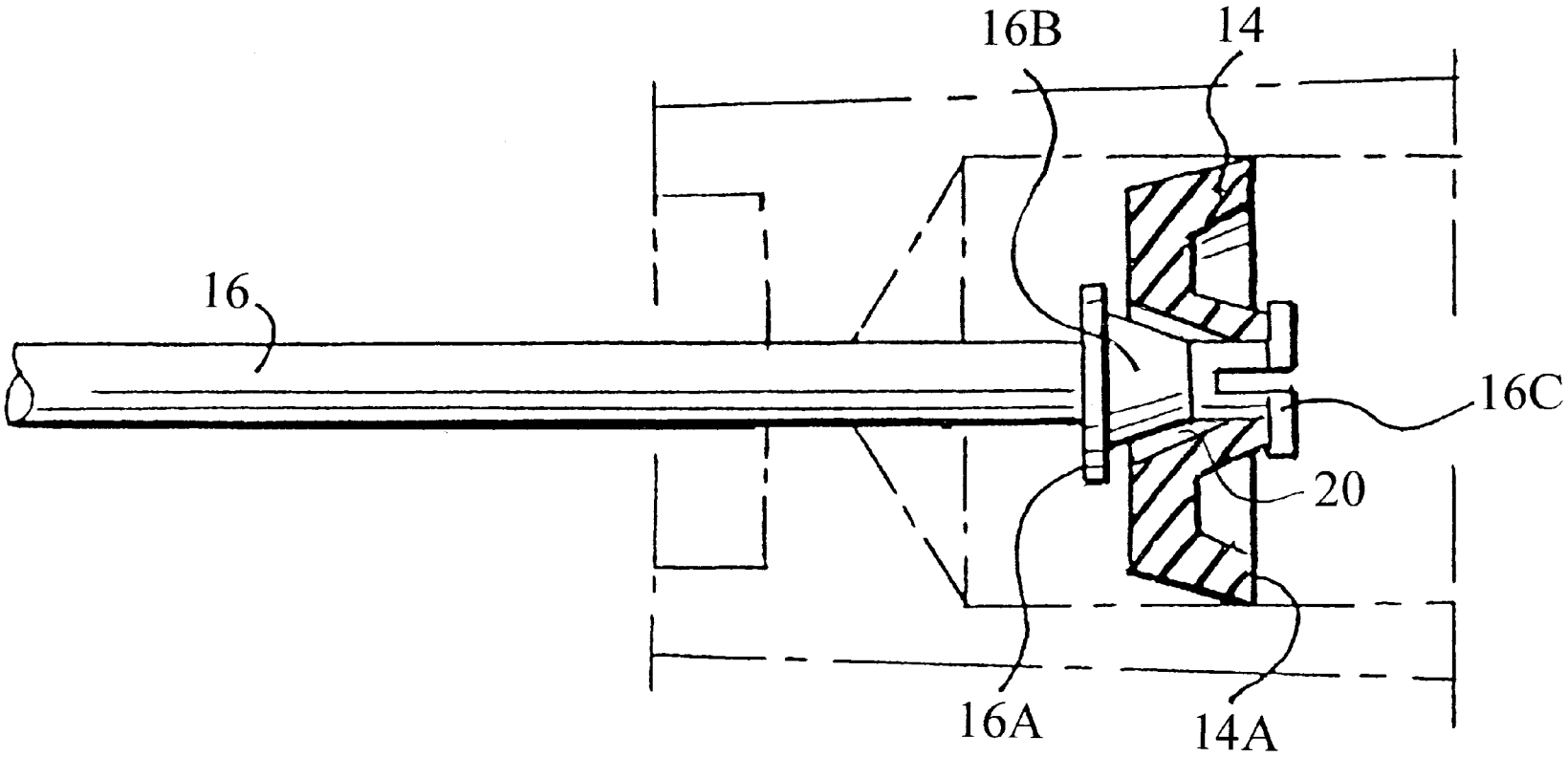
FIG. 6 shows a detail of a piston type valve contained in the pen.

The sleeve 18, which is fixed in place at the opposite end of the body 1 to that attached to the component 9, has a screw thread 18B onto which the end piece 12 can be screwed and force fitted by virtue of a screw thread 12B found on the internal portion 12A of said end piece; in this way the end piece 12 can, as shown in FIGS. 4 and 5, be screwed onto the screw thread 18B on the sleeve 18, forming a secure closure.

In the closed position shown in FIGS. 4 and 5, when the end piece 12 is screwed onto the screw thread 18B of the sleeve 18, it pushes the rod 16 against the piston type valve 14 and pushes the peripheral edge 14A of said valve against the edge 9B which forms the seat for said piston type valve 14. This shuts off the passage between the supply reservoir 10 and the reserve reservoir 3; only the supply reservoir 10, which has a limited capacity of, for example, about 0.6 to 0.8 $cm^3$, remains in communication with the nib, while the larger capacity of the reserve reservoir 3 is cut off from the supply reservoir 10, and ink is supplied to the nib 5 by this reservoir 10. There are therefore no changes in the volume of the contents of the supply reservoir 10—or any changes are at most very slight—and the disadvantages mentioned earlier which occur as a result of a drop in external pressure or an increase in external temperature are avoided.

Once the contents of the supply reservoir 10 have been used up, all the user needs to do is to unscrew the end piece 12 part of the way off the screw thread 18B and thereby also pull the rod 16 a little way back from the piston type valve 14 and/or pull the piston type valve 14 away from the seat 9B formed by the component 9; this movement opens the passage between the two reservoirs 3 and 10 and ink can then flow from the reserve reservoir 3 into the supply reservoir 10, after which—by screwing the end piece 12 back on—the piston type valve 14 is brought back into the closed position and the passage between the two reservoirs 10 and 3 is shut off.

Figure 2:
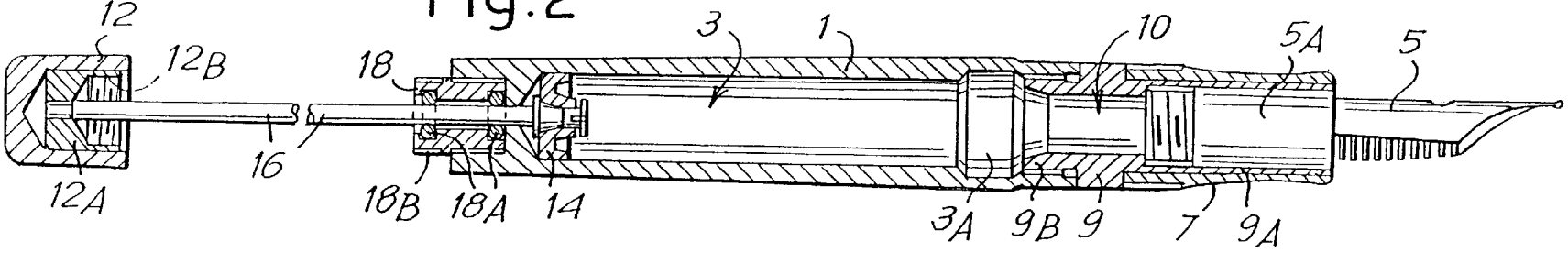
FIGS. 2, 3, 4 and 5 show, in isolation, the pen in axial section and in various positions that can be assumed for the stages of filling the pen, transferring the ink from one reservoir to the other and closing the reservoirs off from each other.
Figure 3:
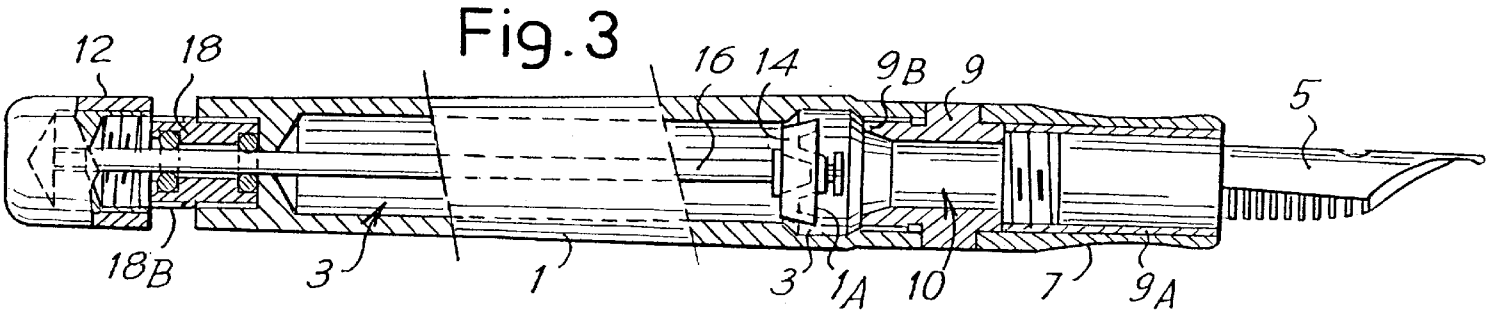

When the pen needs to be refilled with ink, all the user has to do is unscrew the end piece 12 as usual and slide it back so as to bring the piston type valve 14 into the position shown in FIG. 2. The part of the pen from which the nib 5 projects is then immersed into the bottle of ink and the piston type valve 14 is slid from the position shown in FIG. 2 to that shown in FIG. 3, thereby creating a certain degree of vacuum behind said piston type valve 14 in the reservoir 3, until the piston type valve 14 reaches the widened portion 3A as shown in FIG. 3, at which point the vacuum created sucks up the ink which more or less completely fills the reserve reservoir 3 as well as the supply reservoir 10. The end piece 12 is then screwed back onto the screw thread 18B and this shuts of f the passage between the reservoir 3 and the reservoir 10 so that the user can once again write without encountering the disadvantages discussed earlier caused by changes in pressure and/or temperature.

The configuration described also enables the ink contained in the pen, in both the reservoir 10 and the reservoir 3, to be easily emptied out by sliding the rod 16, so that said pen can then be filled with a different type of chosen ink.

The limited capacity of the supply reservoir 10 avoids the disadvantages described above; moreover, what can be the very large capacity of the reserve reservoir 3 means that, compared with the writing spans possible hitherto, the pen can be used for much longer periods of time without having to refill it with ink, and without the disadvantages encountered with conventional pens.

It should be understood that the drawing shows only one example, given solely as a practical demonstration of the invention, and that the forms and configurations of said invention may vary without thereby departing from the scope of the concept on which said invention is based. The presence of reference numerals in the appended claims has the purpose of facilitating reading of the claims with reference to the description and the drawing, and does not limit the scope of protection represented by the claims.

What is claimed is:

1. A fountain-pen comprising:

a body defining a main reservoir;

a nib connected to said body;

a supply reservoir in communication with said nib and said main reservoir, said supply reservoir being smaller than said main reservoir;

an annular seat in said body arranged between said main reservoir and said supply reservoir, said main reservoir having a widened portion adjacent said annular seat;

a valve selectively opening and hermetically closing communication between said supply reservoir and said main reservoir to transfer ink from said main reservoir to said supply reservoir, said valve being a piston type valve which slides along a wall of said main reservoir;

a rod extending from said main reservoir outside said body, said rod having a piston end attached to said piston type valve and an opposite end outside said body fixed to an end piece for manually operating said piston type valve so as to fill the pen by means of suction, said piston type valve engaging said annular seat, said piston end of said rod having a sealing disk arranged on a side of said piston type valve adjacent said main reservoir, said piston end having a shaped split shank extending out of an opposite side of said piston type valve from said main reservoir, said piston end including a cone between said sealing disk and said shaped split shank, said piston type valve being movable between said cone and said shaped split shank, said piston type valve and said shaped split shank defining a rod passage between said valve and said rod when said piston type valve is positioned on said shaped split shank, said piston type valve and said shaped split shank closing said rod passage when said piston type valve is positioned on said cone.

2. Fountain-pen as claims in claim 1, wherein: said rod extends outside said body passing through a sealing bush with a plurality of rings and a silicone lubricant between said rinds for lubrication of said rod.

3. Fountain-pen as claimed in claim 2, wherein said valve engages in a seat formed by a component which delimits said supply reservoir, said component which delimits said supply reservoir is transparent and allows an amount of ink contained in said supply reservoir to be visible.

4. Fountain-pen as claimed in claim 1, wherein the end piece can be screwed onto the body of the main reservoir until said end piece reaches a position which shuts off said rod passage between the valve and the rod and in which said piston type valve bears in a leaktight manner against said seat in said component.

5. The fountain-pen in accordance with claim 1, wherein:

a volume of said main reservoir is sized to have leakage due to changes in temperature and pressure absorbed by said supply reservoir when said valve is opened.

6. The fountain-pen in accordance with claim 1 wherein:

a volume of said supply reservoir is large enough to absorb a flow of ink from said main reservoir due to changes in temperature and pressure when said valve is opened.

7. fountain-pen in accordance with claim 1 wherein:

said main reservoir has a volume larger than 0.6 cubic centimeters.

8. A fountain-pen in accordance with claim 1, wherein:

said main reservoir has a volume between 0.6 and 0.8 cubic centimeters.

9. A fountain-pen in accordance with claim 1, wherein:

said rod and said valve form a means for filling said main reservoir.

* * * * *